US005457265A

United States Patent [19]

Heubner et al.

[11] Patent Number: 5,457,265

[45] Date of Patent: Oct. 10, 1995

[54] PROCESS AND MEANS FOR THE OXIDATIVE DESTRUCTION OF AZIDES

[75] Inventors: Arnulf Heubner, Mainz; Michael Schwarz, Gross-Gerau; Bernd Reckmann, Seeheim-Jugenheim, all of Germany

[73] Assignee: Merck Patent Gesellschaft Mit Beschrankter Haftung, Darmstadt, Germany

[21] Appl. No.: 94,728

[22] Filed: Jul. 21, 1993

[30] Foreign Application Priority Data

Jul. 22, 1992 [DE] Germany ..... 42 24 114.6

[51] Int. Cl.[6] ..... A62D 3/00

[52] U.S. Cl. ..... 588/246; 588/203; 423/410; 210/753; 210/903

[58] Field of Search ..... 588/221, 246; 423/410; 210/753, 903

[56] References Cited

U.S. PATENT DOCUMENTS 3,768,865 10/1973 Dehn ..... 299/4
5,073,273 12/1991 Gupta et al. ..... 210/760

OTHER PUBLICATIONS

Mellor, J. W. A Comprehensive Theatise on inorganic & theoretical Chemistry, Longsman Green & Co. New York, NY 1949 vol. VIII p. 317.
Fundamentals of Analytical Chemistry, 1969, Skoog, p. 434.
Holleman–Wiberg "Lehrbuch der Anorganischen Chemie", Berlin–New York 1985, pp. 568–570.
Chemical Abstracts, vol. III, No. 26, 239274g.
Browning, Jon E. Chemical Engineering "Tableting" Dec. 4, 1967 pp. 151–170.
Summerville, et al. Clinical Chemistry "Iodine–Azide Spot Test. . . " vol. 28 No. 4, 1982 pp. 717–718.
Jirousek, Ludek Analytical Biochemistry "On the Reaction of Sulfenyl Iodide Denv. w/Azide" 1974(61), pp. 434–440.
Armour et al., "Safety in the Chemical Laboratory", *J. Chem. Educ.* 62 vol. 62, No. 3, A93 (03/85).

*Primary Examiner*—Gary P. Straub
*Attorney, Agent, or Firm*—Millen, White, Zelano & Branigan

[57] ABSTRACT

The invention relates to a process and means for the oxidative destruction of azides. The process is characterized in that the azide-containing solutions to be disposed of are treated with an iodine solution in the presence of an iodide and a thiosulfate. The means are preferably employed in the form of tablets.

14 Claims, No Drawings

PROCESS AND MEANS FOR THE OXIDATIVE DESTRUCTION OF AZIDES

The invention relates to a process and means for the oxidative destruction of azides, in particular to the disposal of azide-containing solutions from the clinical chemistry field, as are obtained, for example, in the course of diagnosis in the laboratory.

BACKGROUND OF THE INVENTION

Sodium azide is used almost exclusively for the preservation of aqueous solutions in diagnostic test sets. The problem of the destruction of azides from wastes is referred to in the literature; however, there are no useful solutions to this problem known from the prior art. In U.S. Pat. No. 3,768,865, it is proposed to store salt solutions polluted with azide in underground caverns until they are essentially free of azide, and then to pump the solutions to the earth's surface again. In J. Chem. Educ. 62, 93 (1985), it is mentioned that oxidation with cerium(IV) ammonium sulfate is a frequently described method for the destruction of inorganic azides, but the reaction takes place extremely slowly and is not satisfactory.

Until now, there was no suitable method for the disposal of azides in wastes. The invention is therefore based on the object of making available a means and process which avoid the disadvantages described and enable destruction of azides which spares the environment, i.e. which give no harmful degradation products.

SUMMARY OF THE INVENTION

The invention relates to a process for oxidative destruction of azides, which is characterized in that the azide-containing solutions to be disposed of are treated with an iodine/iodide solution in the presence of thiosulfate.

The invention further relates to a means for the oxidative destruction of azides, characterized by iodine/iodide- and thiosulfate-containing tablets, and its use for the disposal of azides, preferably in solutions from the clinical chemistry field.

DESCRIPTION OF THE INVENTION

The oxidation of hydrazoic acid with iodine in the presence of some thiosulfate as a catalyst converts the acid quantitatively into nitrogen. This reaction was known until now for the analysis of hydrazoic acid. However, it has not found a way into the long-existing need for the safe disposal of azides.

Surprisingly, it has been shown that the process according to the invention is effective even at extremely low concentrations of azide in an excess of serum constituents and buffer substances. For example, solutions containing 0.1 to 10 mmol/liter of azide can be treated according to the process. It can be concluded from this that the azide reacts very rapidly, even before the iodine is used up by other oxidizable serum constituents.

The nature of the cation for the azide in the composition to be treated is not critical. The invention is thus applicable to any azide, e.g., but not limited to, inorganic or organic azides, including alkali metal azides, alkaline earth metal azides and heavy metal azides. Sodium azide is particularly of interest.

The process according to the invention is carried out by adding a catalytic amount of a thiosulfate and an iodine solution to the azide-containing waste solution until there is a permanent coloration. The thiosulfate and iodine may be added simultaneously or consecutively in either order, but, even when added simultaneously, they should be added separately.

After a certain time of action, for example fifteen minutes, excess iodine can be converted into iodide using thiosulfate or other reducing agents such as metabisulphite, dithionite or ascorbic acid. The oxidation with iodine is completely independent of the pH, but it is preferably carried out in buffered systems. The pH of the solutions to be disposed of is preferably 6–9.

The iodine solution employed is an aqueous solution of iodine, optionally, with potassium iodide in a weight ratio of about 2:1. This ratio is not critical, however, and can be varied within a wide range, for example, from about 2:1 to about 20:1, more preferably about 2:1 to about 4:1. The iodide can be added with the iodine, the thiosulfate or both. The above ratios relate to the total amount of iodide used. The iodine concentration to be employed is dependent on the content of oxidizable substances in the waste solution. Since 0.5 mol of iodine ($I_2$) are consumed for the destruction of one mol of azide, for example sodium azide, 126.9 g of iodine per mol of sodium azide is the minimum amount which is necessary for this purpose. It is preferred for purposes of economy that no more than 1.0 mol of iodine per one mol of sodium azide be used. The azide concentrations in the waste as a rule vary within the order of magnitude of a few mmol/liter, so correspondingly small amounts of iodine are necessary.

Iodine/potassium iodide and also sodium thiosulfate are preferably employed in the form of tablets. An iodine/potassium iodide tablet for the disposal of 1 l of azide-containing waste may contain, for example, 1 g of iodine and 0.5 g of potassium iodide in addition to customary tabletting auxiliaries such as polyethylene glycol, magnesium sulfate, magnesium carbonate, mannitol, sorbitol, methylcellulose, calcium stearate, etc. The sodium thiosulfate concentration is about 0.1 to 1% by weight of the iodine concentration. It is also possible to compress into a tablet the iodide together with the thiosulfate, or tablet part of the iodide together with iodine and part with the thiosulfate in separate tablets.

One aspect of the invention is a kit provided with the thiosulfate-containing and iodine-containing tablets which can be added to azide wastes for their disposal.

By virtue of the fact that iodine has an antiseptic, bactericidal, sporicidal, fungicidal and virucidal activity and in the main azide-containing wastes which have to be disposed of are wastes from body fluids, the additional advantage results that with the means according to the invention not only the azide is destroyed, but also all microorganisms are killed.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and unless otherwise indicated, all parts and percentages are by weight.

The entire disclosures of all applications, patents and publications, cited above and below, and of corresponding application(s) German No. P 42 24 114 filed Jul. 22, 1992, are hereby incorporated by reference.

EXAMPLE 1

The waste solution from an analytical apparatus contains 4.89 mmol/l of sodium azide. 200 μl of a 0.1% aqueous sodium thiosulfate solution and 1 ml of a 0.2 % aqueous solution of iodine (7.88 mmol/l) and potassium iodide (7.88 mmol/l) are added to one ml of this solution.

After an incubation time of 15 minutes, sodium thiosulfate solution is added until the solution is completely decolorized. The subsequent measurement of the sodium azide concentration shows that 1.5 μmol of sodium azide are still intact.

EXAMPLE 2

20 μl of the aqueous 0.1% sodium thiosulfate solution and 1 ml of a 0.4% aqueous solution of iodine and potassium iodide are added to one ml the same waste solution as in Example 1.

After an incubation time of 15 minutes and the subsequent decolorization of the solution, sodium azide is no longer detectable. If instead of the sodium thiosulfate solution a solution of sodium metabisulphite, sodium dithionite or ascorbic acid is employed for decolorization, this does not change the result.

EXAMPLE 3

The following tablets are added to a sodium azide-containing waste solution:

The 1st tablet contains
8.00% of potassium iodide
0.09% of sodium thiosulfate
48.81% of basic magnesium carbonate
40.00% of magnesium sulfate
0.10% of calcium stearate
3.00% of talc (The percentages given are by weight.)

The 2nd tablet contains
52.7 g of polyethylene glycol 400
8.3 g of polyethylene glycol 4000
16.9 g of polyethylene glycol 6000
10.0 g of iodine
10.0 g of water After an incubation time of about 15 minutes, the solution is optionally decolorized with a sodium thiosulfate solution or a tablet which essentially contains sodium thiosulfate.

EXAMPLE 4

The following tablets are employed analogously to Example 3.

The 1st tablet contains
0.09% of sodium thiosulfate
52.81% of basic magnesium carbonate
44.00% of magnesium sulfate
0.10% of calcium stearate
3.00% of talc (The percentages are given by weight.)

The 2nd tablet contains
52.7 g of polyethylene glycol 400
8.3 g of polyethylene glycol 4000
16.9 g of polyethylene glycol 6000

10.0 g of iodine
5.0 g of potassium iodide
10.0 g of water

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for the oxidative destruction of azide salts in an azide salt-containing solution, which comprises:

adding a thiosulfate, iodine and an iodide to said solution in sufficient amounts such that at least 69% of the azide salts in the solution are destroyed.

2. The process of claim 1 wherein a thiosulfate-containing tablet is added into the azide salt-containing solution and an iodine-containing tablet is added into the azide salt-containing solution, wherein at least one of the said tablets also contains an iodide.

3. The process of claim 1 wherein the iodine and iodide are added together as an aqueous solution to the azide salt-containing solution.

4. The process of claim 1 further comprising subsequently adding a reducing agent to the treated solution to convert any excess iodine into an iodide.

5. The process of claim 4 wherein the reducing agent is a thiosulfate, metabisulfite, dithionite or ascorbic acid.

6. The process of claim 1 wherein the pH of the azide salt-azide salt-containing solution is 6–9.

7. The process of claim 1 wherein the iodide is potassium iodide and the weight ratio of iodine to potassium iodide is about 2:1 to 20:1.

8. The process of claim 7 wherein the weight ratio of iodine to potassium iodide is about 2:1 to 4:1.

9. The process of claim 1 wherein iodine is used in an amount of from 0.5 to 1.0 mol per mol of azide salt in the azide salt-containing solution.

10. The process of claim 1 wherein the thiosulfate is sodium thiosulfate which is used in an amount of 0.1–1.0% by weight of the iodine.

11. The process of claim 1, wherein the azide salt-containing solution contains 0.1–10 mmol/l of azide salts before addition of the thiosulfate, iodine and iodide.

12. The process of claim 11, wherein the azide salts-containing in the azide salt-containing solution are essentially completely destroyed.

13. The process of claim 1, wherein the azide salts in the azide salt-containing solution are essentially completely destroyed.

14. The process of claim 1, wherein the azide salts in the azide salt-containing solution comprise alkali metal azides, alkaline earth metal azides, heavy metal azides or mixtures thereof.

* * * * *